US006298988B1

(12) United States Patent
Wen-Chien

(10) Patent No.: US 6,298,988 B1
(45) Date of Patent: Oct. 9, 2001

(54) GOLF BAG HAVING BASE ACTUATING DEVICE AND BAG TILTING DEVICE

(76) Inventor: Cheng Wen-Chien, 4th Floor, 8 Lane 153, Chung Hsin Road Sec.2, Ta Li City, Taichung Hsien (TW)

( * ) Notice: Subject to any disclaimer, the term of this patent is extended or adjusted under 35 U.S.C. 154(b) by 0 days.

(21) Appl. No.: 09/472,422

(22) Filed: Dec. 27, 1999

(51) Int. Cl.[7] ..... A63B 55/00; A63B 55/06

(52) U.S. Cl. ..... 206/315.7; 206/315.3; 248/96

(58) Field of Search ..... 206/315.3, 315.7, 206/315.8; 248/96

(56) References Cited

U.S. PATENT DOCUMENTS 5,901,845 * 5/1999 Cheng ..... 206/315.7
6,098,797 * 8/2000 Han ..... 206/315.7
6,220,433 * 4/2001 Kang ..... 206/315.7

* cited by examiner

*Primary Examiner*—Sue A. Weaver
(74) *Attorney, Agent, or Firm*—Harrison & Egbert

(57) ABSTRACT

A golf bag has a bag body which is provided at the bottom end thereof with a base having an inclined portion. The inclined portion is provided with a recess and a through hole. The golf bag is provided with a bag tilting device having two support rods, and a bracing rod which is fastened with one end of a contact rod. The contact rod is fastened at other end thereof with the receiving seat of an action plate via the through hole of the inclined portion of the base. The action plate is smaller in size than the recess of the inclined portion of the base such that the action plate is concealed in the recess at such time the bag body is tilted.

3 Claims, 4 Drawing Sheets

GOLF BAG HAVING BASE ACTUATING DEVICE AND BAG TILTING DEVICE

FIELD OF THE INVENTION

The present invention relates generally to a golf bag, and more particularly to a golf bag having a device for actuating the base of the golf bag and a device for tilting the golf bag body.

BACKGROUND OF THE INVENTION

The conventional golf bag is generally provided with a device for actuating the base of the golf bag and a device for tilting the golf bag. The base has an inclined front edge to facilitate the tilting of the golf bag. The construction of the inclined front edge undermines the structural integrity and strength of the base. The base also has an action plate which is fastened pivotally to the bag tilting device at the expense of the aesthetic effect of the base. In addition, the action plate can not be pivoted with the base easily nor economically.

SUMMARY OF THE INVENTION

The primary objective of the present invention is to provide a golf bag with a base having an inclined portion. The inclined portion has a recess having a through hole. The golf bag is has a bag tilting device comprising a contact rod which is connected with an action plate via the through hole of the inclined portion of the base. The structural relationship between the base and the action plate is thus strengthened.

The features and functions of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
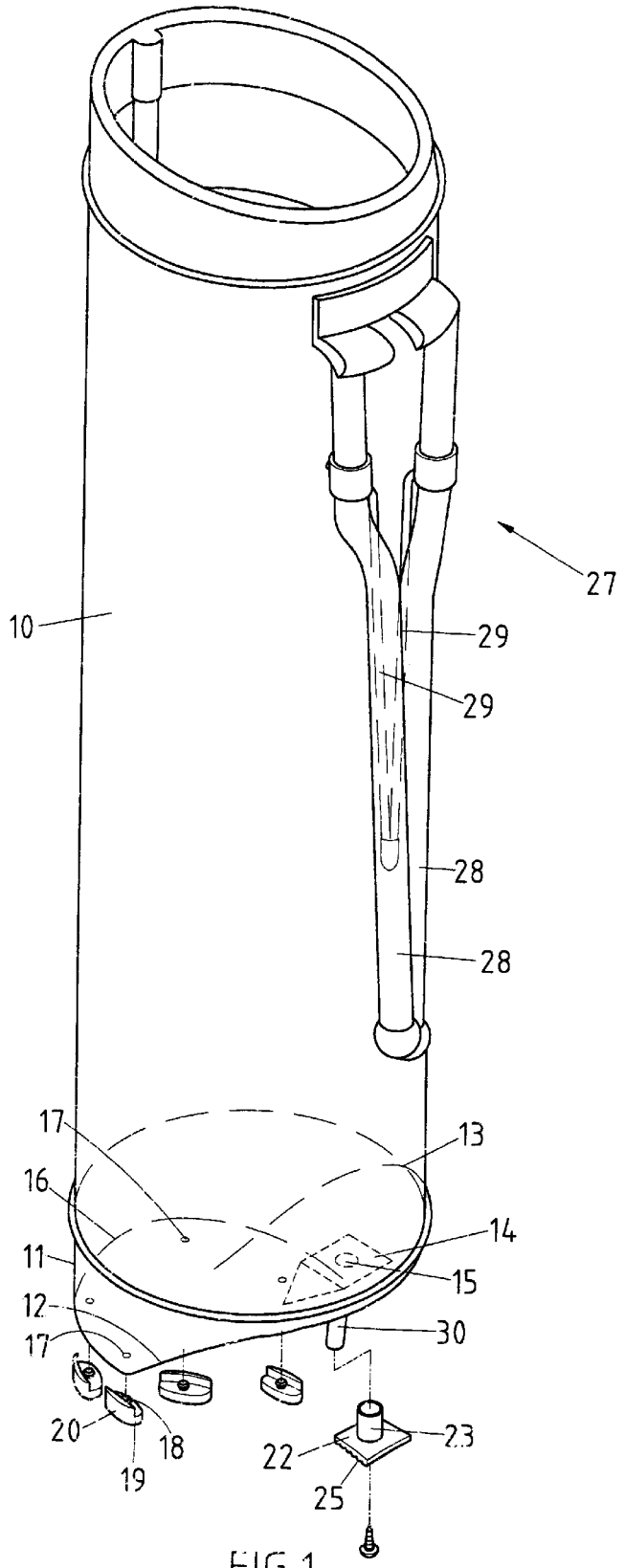
FIG. 1 shows an exploded view of the preferred embodiment of the present invention.
Figure 2:
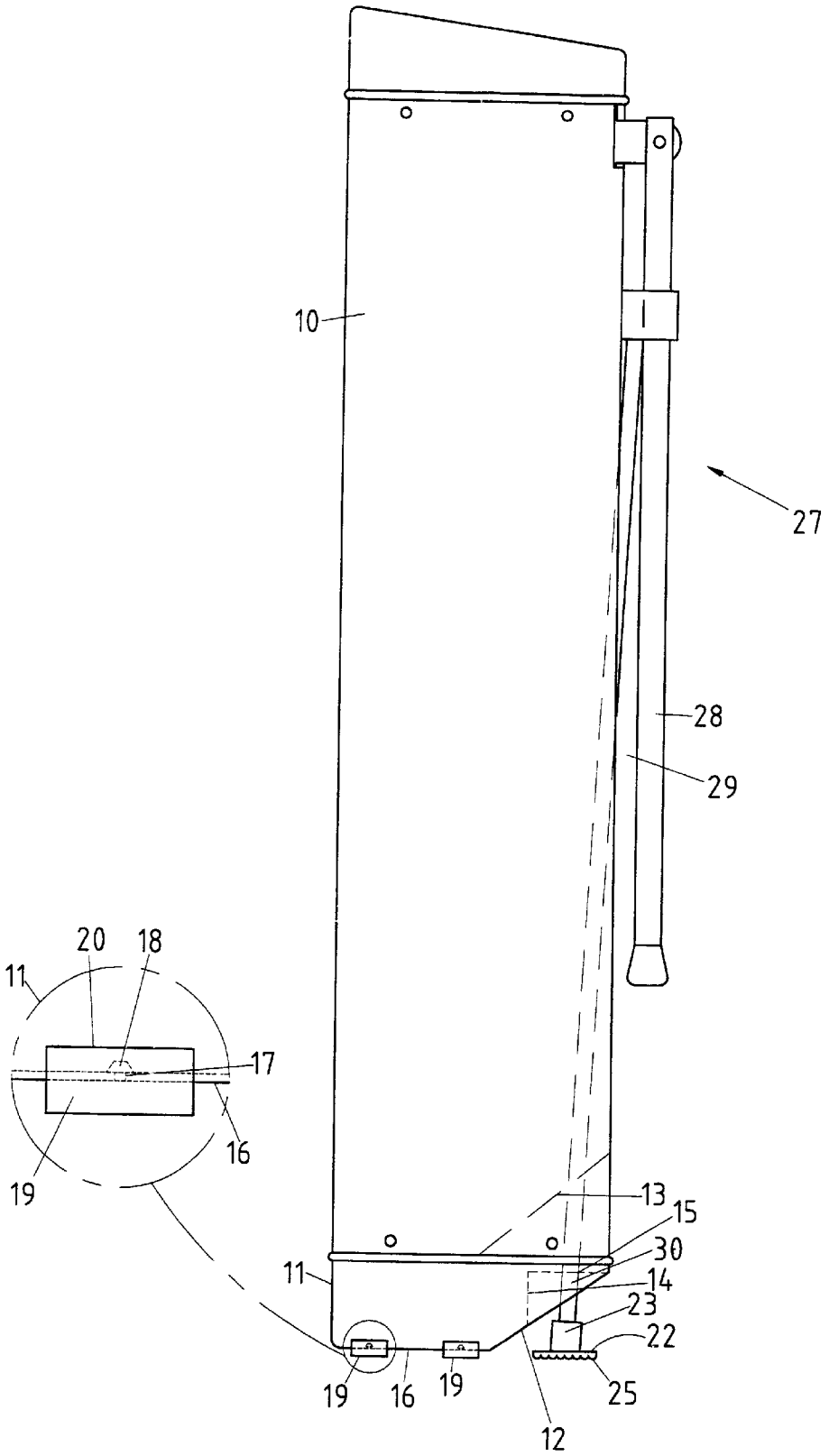
FIG. 2 shows a side view of the preferred embodiment of the present invention.
Figure 3:
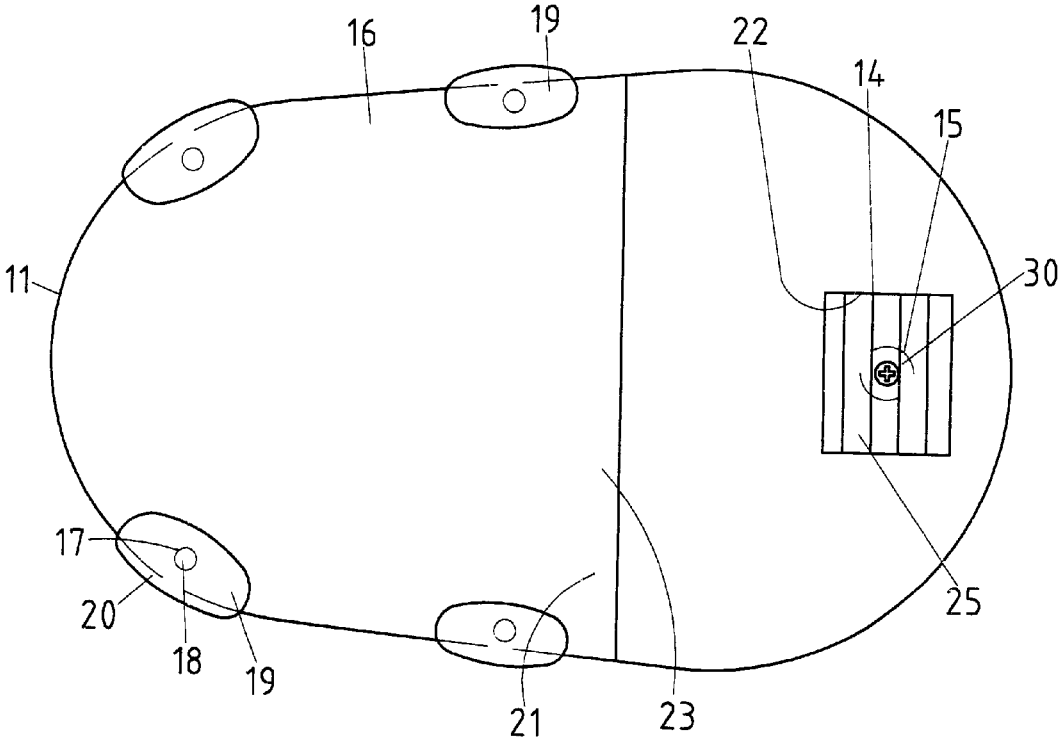
FIG. 3 shows a bottom view of the present invention.
Figure 4:
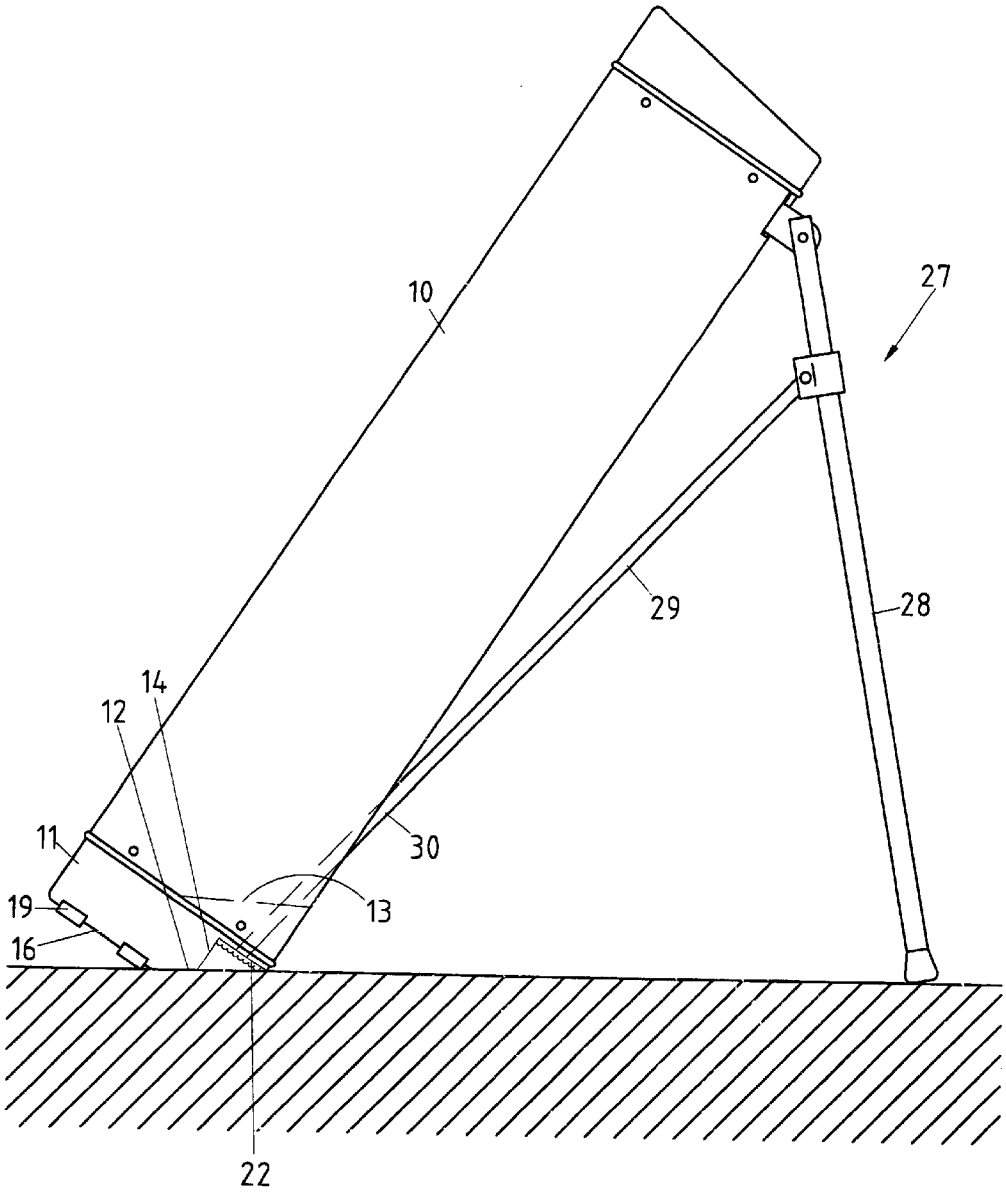
FIG. 4 shows a schematic view of the preferred embodiment of the present invention in action.

A shown in FIGS. 1–4, a golf bag 10 of the preferred embodiment of the present invention has a base 11, an action plate 22, and a bag tilting device 27.

The base 11 is provided with an inclined portion 12 having a protruded circular wall 13, a recess 14, and a through hole 15. The base 11 is further provided with a rear portion 16 having a plurality of insertion holes 17 for receiving the insertion pillars 18 of the contact blocks 19. The contact blocks 19 have an upright edge 20.

The action plate 22 has an underside surface with a skidproof surface 25, and has an upper surface with a receiving seat 23 of a tubular construction.

The bag tilting device 27 is fastened to the upper portion of the golf bag 10 and is composed of two support rods 28, which are branched at the upper end thereof and fastened pivotally, and a bracing rod 29, which is fastened at one end thereof with a contact rod 30. The contact rod 30 is fastened at the other end thereof with the receiving seat 23.

The structural strength of the base 11 of the preferred embodiment of the present invention is thus enhanced by virtue of the protruded circular wall 13 in conjunction with the recess 14. The contact rod 30 of the bag tilting device 27 is received at the bottom end thereof in the receiving seat 23 of the action plate 22. The action plate 22 is smaller in size than the recess 14 and is thus concealed in the recess 14 at the time when the golf bag 10 is tilted.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A golf bag comprising:

a bag body;

a base fastened at a bottom end of said bag body and provided with an inclined portion which is in turn provided with a protruded circular wall, a recess, and a through hole, said base further provided with a rear portion having a plurality of insertion holes for receiving a plurality of insertion pillars of contact blocks whereby said contact blocks have an upright edge;

an action plate provided in the underside thereof with a skidproof surface, and in the upper surface thereof with a receiving seat of a tubular construction; and a bag tilting device fastened with the upper portion of said bag body and formed of two support rods and a bracing rod which is fastened at one end thereof with a contact rod whereby said contact rod is fastened at other end thereof with said receiving seat.

2. The golf bag as defined in claim 1, wherein said action plate is smaller in size than said recess of said inclined portion of said base such that said action plate is concealed in said recess at such time when said bag body is tilted.

3. The golf bag as defined in claim 1, wherein said contact rod is fastened with said receiving seat via said through hole of said inclined portion of said base.

* * * * *